US009159308B1

(12) United States Patent
Scharfeld

(10) Patent No.: US 9,159,308 B1
(45) Date of Patent: Oct. 13, 2015

(54) ELECTRONIC MUSICAL INSTRUMENTS

(71) Applicant: Spoonjack, LLC, San Francisco, CA (US)

(72) Inventor: Tom Ahlkvist Scharfeld, Santa Barbara, CA (US)

( * ) Notice: Subject to any disclaimer, the term of this patent is extended or adjusted under 35 U.S.C. 154(b) by 0 days.

(21) Appl. No.: 14/016,216

(22) Filed: Sep. 2, 2013

Related U.S. Application Data

(63) Continuation of application No. 13/568,125, filed on Aug. 6, 2012, now Pat. No. 8,525,014, which is a continuation of application No. 12/708,532, filed on Feb. 18, 2010, now Pat. No. 8,237,042.

(60) Provisional application No. 61/153,584, filed on Feb. 18, 2009.

(51) Int. Cl.
*G10H 1/02* (2006.01)

(52) U.S. Cl.
CPC ..... *G10H 1/02* (2013.01)

(58) Field of Classification Search
CPC . A01B 12/006; G10H 1/02; G10H 2220/096; G10H 2220/201; G10H 2230/015; G10H 2220/161
USPC ..... 84/600, 626, 662, 735, 610, 611, 667
See application file for complete search history.

(56) References Cited

U.S. PATENT DOCUMENTS

| | | | | | |
|---|---|---|---|---|---|
| 5,310,962 | A * | 5/1994 | Kimpara et al. | ..... | 84/600 |
| 5,763,804 | A * | 6/1998 | Rigopulos et al. | ..... | 84/635 |
| 6,011,212 | A * | 1/2000 | Rigopulos et al. | ..... | 84/667 |
| 6,489,550 | B1 * | 12/2002 | Takahashi et al. | ..... | 84/724 |
| 7,161,079 | B2 * | 1/2007 | Nishitani et al. | ..... | 84/612 |
| 7,402,743 | B2 * | 7/2008 | Clark et al. | ..... | 84/615 |
| 7,504,577 | B2 * | 3/2009 | Riopelle | ..... | 84/723 |
| 7,858,870 | B2 * | 12/2010 | Riopelle | ..... | 84/622 |
| 8,218,790 | B2 * | 7/2012 | Bull et al. | ..... | 381/104 |
| 8,222,507 | B1 * | 7/2012 | Salazar et al. | ..... | 84/602 |
| 8,237,042 | B2 * | 8/2012 | Scharfeld | ..... | 84/662 |
| 8,242,344 | B2 * | 8/2012 | Moffatt | ..... | 84/609 |
| 2002/0026866 | A1 * | 3/2002 | Nishitani et al. | ..... | 84/600 |
| 2003/0110929 | A1 * | 6/2003 | Riopelle | ..... | 84/615 |
| 2010/0206156 | A1 * | 8/2010 | Scharfeld | ..... | 84/604 |

* cited by examiner

*Primary Examiner* — Jeffrey Donels

(57) ABSTRACT

Methods and a system for providing electronic musical instruments are disclosed. Through novel combinations of sensor inputs and processing, they allow simulation of acoustic instruments including but not limited to a Trombone, Trumpet, and Saxophone. Sensor inputs are configured to trigger playback and transitioning of sound and control its various attributes alone, or in combination.

20 Claims, 13 Drawing Sheets

ELECTRONIC MUSICAL INSTRUMENTS

CROSS REFERENCE TO RELATED APPLICATIONS

This application is a continuation of U.S. patent application Ser. No. 13/568,125, filed Aug. 6, 2012, now U.S. Pat. No. 8,525,014, which is a continuation of U.S. patent application Ser. No. 12/708,532, filed Feb. 18, 2010, now U.S. Pat. No. 8,237,042, which claims priority to provisional U.S. patent application Ser. No. 61/153,584 filed Feb. 18, 2009. Each of the aforementioned U.S. patent application Ser. No. 13/568,125 and U.S. patent application Ser. No. 12/708,532, is incorporated herein by reference in its entirety.

FIELD OF THE INVENTION

The present invention relates to electronic musical instruments.

SUMMARY

The present invention provides a system and methods for an electronic musical instrument. Through a novel combination of sensor inputs, it allows simulation of real world instruments including but not limited to a Trombone, Trumpet and Saxophone.

The device itself includes a series of sensor inputs configured to act as a user interface, and a speaker to output sound. Various sensors can be employed, including a touch screen, microphone, accelerometer, and camera or light sensor.

Sensor inputs are processed through a set of sub-processors to determine events and respond accordingly with parameters and actions for manipulating sound. Attributes that can be varied include tone, pitch, attack/accent (also known as velocity), volume, and special modes such as vibrato, growl or tonguing. Parameters and commands are sent to a playback processor which responds to the input parameters and commands by processing stored digital representations of sounds and sends them to an output buffer for playback.

Generated sounds are stored digitally as either data, or algorithms/equations. They are contained within a Tone data object which comprises a set of representations which may provide different phases and/or qualities.

Sensor inputs can be configured to trigger playback of sound and control its various attributes either alone, or in combination. For example, Tone and pitch may be determined exclusively by location of touches on a display, or by a combination of device rotation and touch location. These methods are illustrated by a variety of embodiments including a simulated Trombone, Trumpet, and Saxophone.

Further objects, advantages, and features of the invention will become apparent from a consideration of the drawings and ensuing description.

BRIEF DESCRIPTION OF THE DRAWINGS

Presently preferred embodiments of the invention are described below in conjunction with the appended drawing figures, wherein like reference numerals refer to the like elements in the various figures, and wherein:

FIG. 11-14 are diagrams of the present invention embodied as a Trumpet. FIGS. 11 and 12 are configured to control Tone and pitch exclusively by touch, whereas In FIG. 13A (front view) and 13B (side view) Tone and pitch are set by rotating about the X axis, whereas in FIG. 14A (front view) and 14B (side view), Tone and pitch are set by rotating about the Y axis.

FIG. 18 is a diagram of the present invention embodied as a Saxophone.

DETAILED DESCRIPTION

The system of the present invention comprises an electronic device with sensor inputs configured to act as a user interface and speaker output to produce sound responsive to the inputs.

Figure 1:
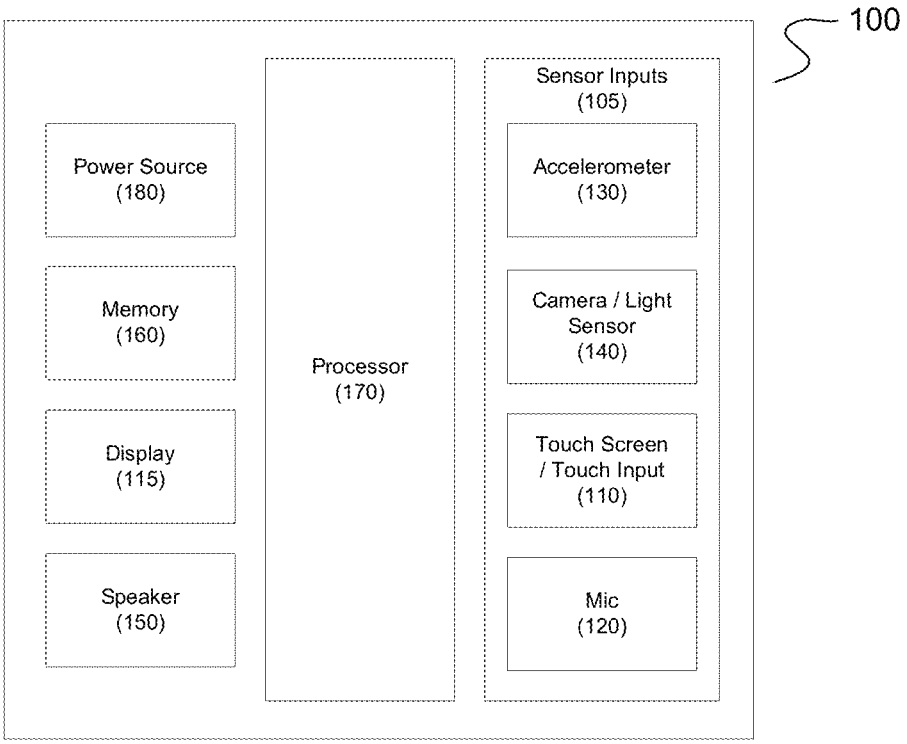
FIG. 1 is a block diagram of the device of one embodiment of the present invention.

FIG. 1 shows a block diagram of such a device 100. It has a set of sensor inputs 105 including, but not limited to:

(1) a touch screen 110 which can sense location and optionally force (or touch area), (2) a microphone 120, (3) a 1 to 3 axis accelerometer 130, (4) a camera and/or light sensor 140.

It has a speaker 150 for outputting sound, one or more digital sound representations, a memory 160 for storing them, and a processor 170 for executing software capable of receiving configuration parameters, maintaining state, receiving sensor input data, processing the input data, and responding. The response is done in accordance with the configuration parameters, system state, and the input events. It involves controlling playback of audio through the speaker; sounds may be started and stopped and attributes such as tone, pitch, accent, nuance, volume, and vibrato may be varied. A power source powers the device 180, and display may be attached to the touch screen or separate 115.

Sound Representation

Figure 2:
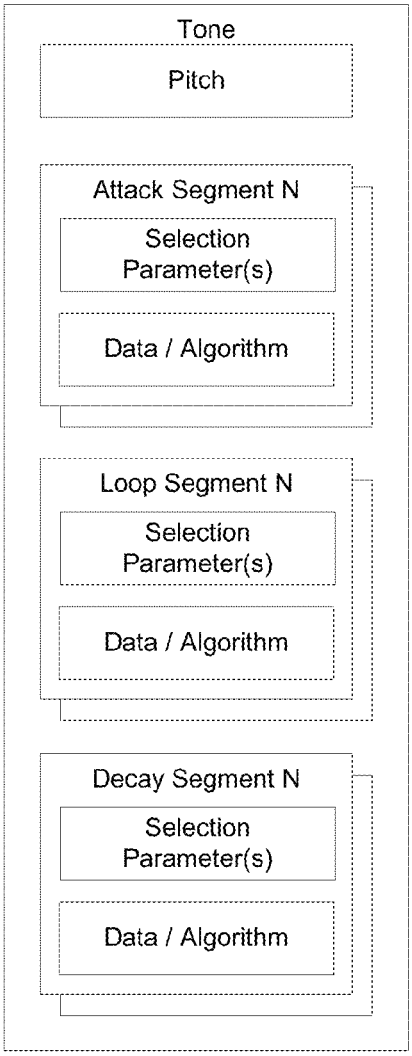
FIG. 2 is a diagram of the Tone data object model.

Audio to be output is represented digitally within a data object called a Tone. As shown in FIG. 2, a Tone comprises one or more digital representations, where the representation is either digital data or an equation or algorithm. The data files have an inherent pitch, which is later adjusted to produce alternative pitches. The data files may be split into different phases, including, for example, attack, loop, and decay. The attack segment is the beginning of a Tone, the loop segment is to be looped repeatedly as long as the note is intended to be sustained, and the decay segment is played once playback of the Tone is to be stopped. Alternatively to storing the phases in separate files, they may be stored in a single file and instead indicated by times from the start of the file.

One or more representations of the Tone which offer different musical nuance with the same inherent pitch may be contained within the Tone. For example, the Tone may consist of a set of attack, loop and decay files which have a strong accent and vibrato, and another set of which have a soft accent and a steady sustain. Parameters for selecting one set versus another are also stored within the Tone model and associated with each set. An example of such a parameter would be, "Volume >0.5", which would indicate that the particular representation by played if the volume output is above 0.5.

In some embodiments, sound waveforms may also be generated by algorithmic and/or mathematical models, or some combination thereof. In this case, the algorithm or model is associated with the Tone. If no stored representations are used, the pitch may be set directly.

Event Processing and Output

Figure 3:
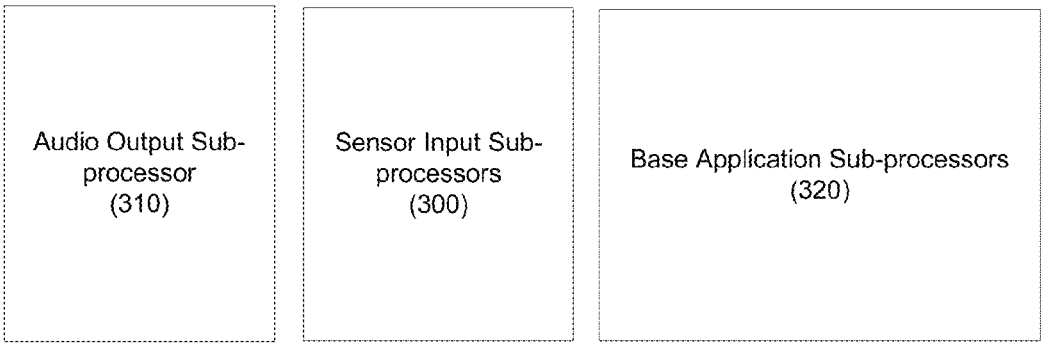
FIG. 3 is a block diagram of the system sub-processors.

As shown in FIG. 3, three classes of sub-processors are used to provide system functionality: one, the sensor event sub-processor 300, two, the audio output sub-processor 310, and three, the base application sub-processors 320. The base application sub-processors are for controlling system views, configurations, and interacting with models beyond what is performed by the two other classes of sub-processors.

Figure 4:
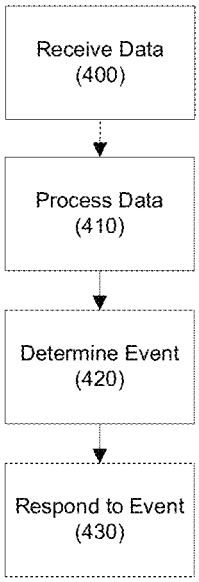
FIG. 4 is a flow diagram of the general steps performed periodically by the sensor input sub-processors.

As shown in FIG. 4, sensor event sub-processors receive 400 sensor data, process 410 the data to determine 420 actionable events, and respond 430 to the events in accordance with configuration flags, and system state. The response consists of either sending (1) a command and parameters to the audio output sub-processor and/or setting (2) flags to be used by other sensor event sub-processors, which in turn send commands and parameters to the audio output sub-processor. The series of steps is executed repeatedly often at intervals less than 10 ms.

Figure 5:
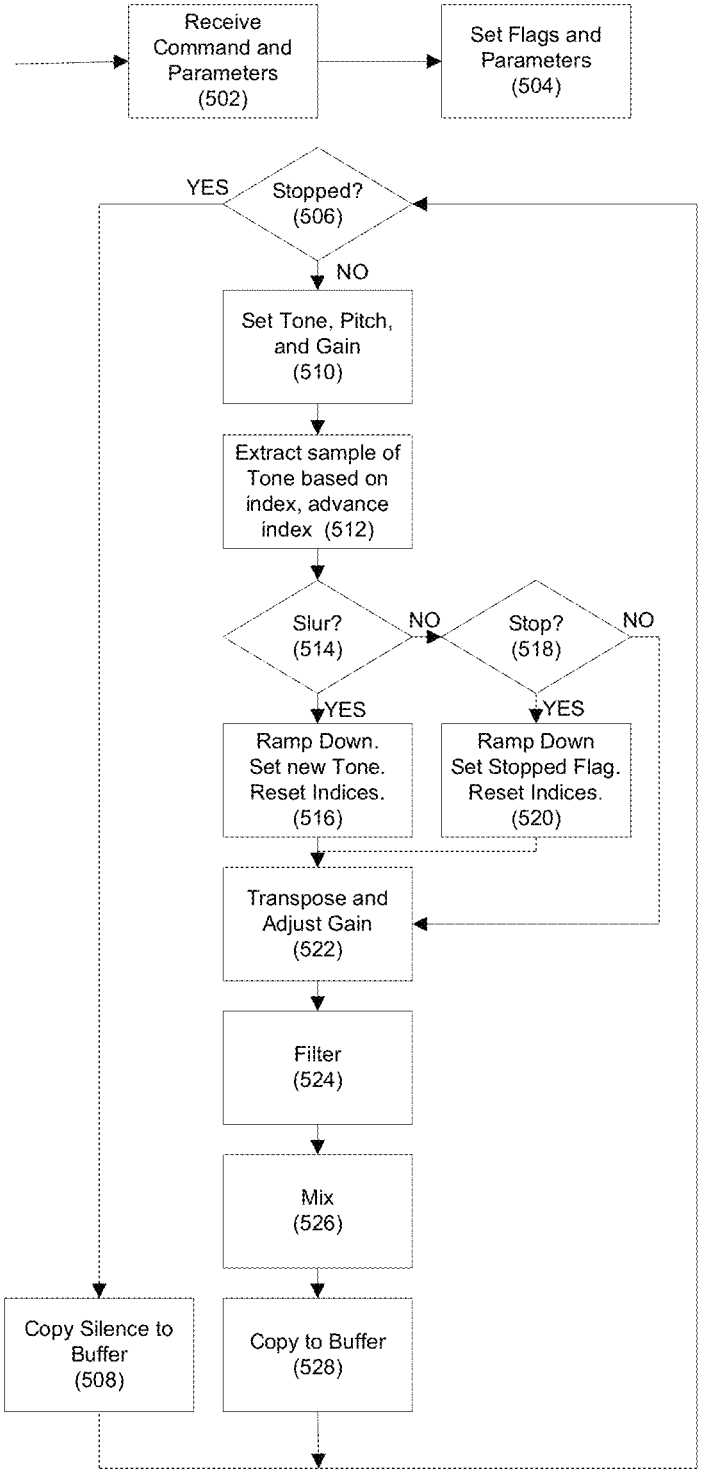
FIG. 5 is a flow diagram of the general steps performed periodically by the audio output sub-processor, also referred to as the playback processor.

The audio output sub-processor is responsible for receiving and executing instructions on sound playback. FIG. 5 illustrates the overall process by which it operates. On receipt 502 of commands it sets 504 flags and parameters which are then acted on by a "callback" function which executes periodically at a rate determined by the audio sampling rate and audio buffer size. Assuming it is not stopped 506, in which case it played silence 508, it selects and sets 510 the appropriate Tone, type, pitch and volume. It then extracts 512 a segment of the appropriate data or waveform, prepares for stopping 518,520 or transitioning 514,516 to another note, transposes 522 the waveform and adjusts volume, filters 524, and finally copies the result to the audio output buffer for playback through the system speaker 528. If multiple simultaneous sounds are to be produced, the sounds are mixed 526 prior to copying to the buffer.

The process of FIG. 5 includes two processes for transitioning the sound to silence or another note. When transitioning 516 to silence, the sound is ramped down in volume to prevent clipping and indices tracking position with data or waveform algorithms are reset. When transitioning 520 to another note, the sound is prepared for transition to another note, as might be the case if the note were to be slurred to another note. In a simple embodiment, the sample is ramped down in volume, the indices reset, and the next note and its attributes are set for subsequent processing in the next iteration of the audio output sub-processor.

Methods of Triggering Sound and Setting Attributes

Sounds are triggered and their attributes set by the inputs, alone, or in combination. Inputs may require varying degrees of processing, for example accelerometer input can be filtered to determine angle change or vibration; mic input can be processed to determine level or pitch. Derivative methods may also be employed, for example, in the case of using touch as a trigger, duration between touch events may be used to determine whether a fast attack or a slow attack should be played. (Attack is often referred to as, or linked to note velocity).

Table 1 summarizes various methods by which sounds are triggered and attributes set.

TABLE 1

Methods by which sounds are triggered and controlled

| Attribute | Input(s) | Notes and Examples |
|---|---|---|
| Trigger | Touch | Begin = ON, End = OFF |
| | Mic level | Above threshold = ON, below threshold = OFF |
| | Accelerometer (shake) | Shake = ON, subsequent Shake = OFF |
| | Accelerometer (angle) | Above angle = ON, Below angle = OFF |
| | Camera/Light | Light = ON, Dark = OFF |
| Tone & Pitch | Touch location(s) | |
| | Mic pitch or level | |
| | Accelerometer (angle or shake) | |
| | Camera/Light | |
| | Touch location(s) + Accelerometer (angle or shake) | Angle controls partial, touch location represents pressing keys. Or, shake toggles octave. |
| | Touch location(s) + Camera/Light | As Accelerometer shake, |
| Tone Type | Accelerometer (shake) | Shake = fast attack, no shake = regular attack |
| | Based on Volume | Low volume = slow attack, High volume = fast attack |
| | Based on duration betweenTouches | Short duration = quick attack, Long duration = slow attack |
| | Touch force or area | High force = Fast attack, Low force = Slow attack |
| Volume | Accelerometer (angle) | High angle = High volume, Low angle = Low volume |
| | Touch force or area | High force = high volume, Low force = low volume |
| Mode (i.e. tonguing) | Touch location(s) | |
| | Accelerometer (angle or shake) | |

Several of these methods are illustrated by embodiments representing real instruments including a Trombone, a Trumpet, and a Saxophone.

Trombone

Figure 6:
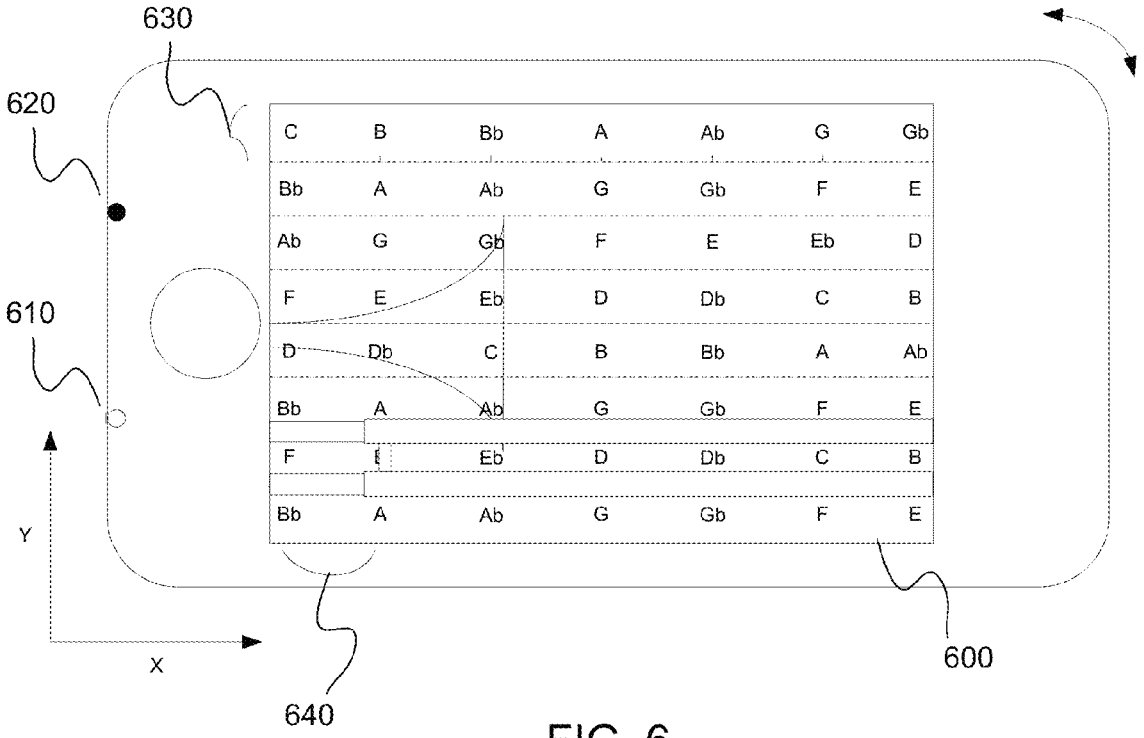
FIG. 6 is a diagram of present invention embodied as a Trombone.

FIG. 6 shows the present invention embodied as a Trombone. A real Trombone consists of a length of brass tubing with a mouthpiece connected at one end, and a flared bell at the other. It has a telescoping slide designed for modifying the effective length of the instrument and thus changing pitch. The slide has seven positions, each marking a semitone decrease in pitch from the $1^{st}$, fully closed position. Sound is generated when a person "buzzes" their lips into a mouthpiece, causing the column of air inside the tubing to vibrate. Pitch is determined by both the frequency of the "buzzing" and the position of the slide.

By tightening lips (embouchure) and "buzzing" at a higher frequency, users can increase the pitch to a higher partial in the overtone series. Simultaneously, by extending the slide they can decrease the pitch by a semitone per position. Quality, nuance and volume are determined largely by the embouchure, and air speed and direction.

As embodied by the present invention. The device has a touch display 600, a mic 610, and speaker 620, with additional sensors and processor electronics contained within the case.

The display is partitioned into 8 overtone partials 630 on the Y-axis, and 7 slide positions 640 along the X-axis. Sound is triggered when a user either blows into the mic, or touches the display. Pitch is determined by the location of the touch on the display. Volume is determined by mic level, force of touch (or area of touch) on the display, or angle of the device as determined by an accelerometer. Attack type, note quality and other nuance are determined by shaking the device, or may be linked directly to volume or duration of notes.

Figure 7:
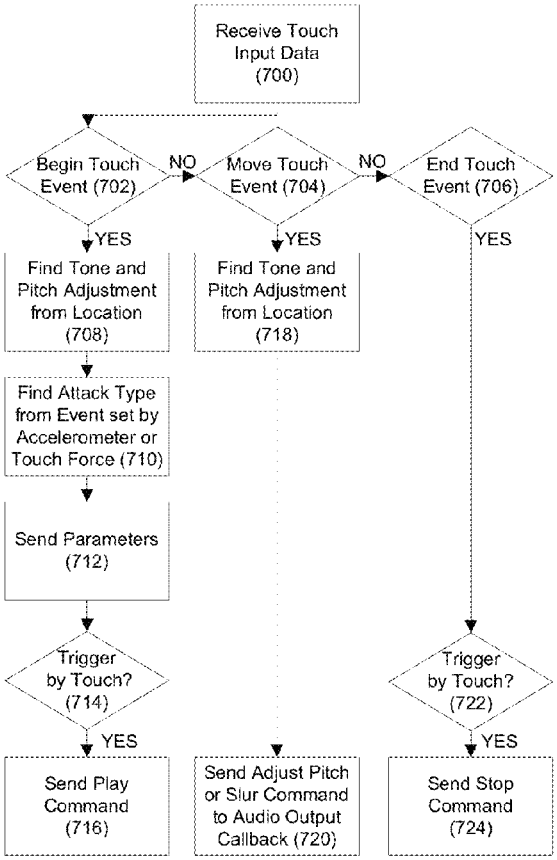
FIG. 7 is a flow diagram of the steps performed by the touch sensor sub-processor for the embodiment of FIG. 6.

FIG. 7 shows a flow diagram of the process by which the processor handles touch events. Display sensor information is received 700 periodically, and processed to determine whether a touch has begun 702, moved 704, or ended 706. If a touch has begun, the tone and pitch adjustment are determined 708 based on location of the touch.

In determining the Tone and pitch, the partial is first determined from the location along the Y-axis. A base Tone (FIG. 2) comprising one or more attack, loop, and decay data files or waveforms is assigned to its corresponding partial in a designated slide position. Table 2 shows a sample of the relationship between Y-axis touch location, pitch in first position (slide closed), and assigned Tone.

TABLE 2

Sample association between Y-position, partial, base Tone and pitch

| Y-position [pixels] | $1^{st}$ Pos. Note | Assigned Tone | Adjustment Semitones |
|---|---|---|---|
| 7-8 * pixels/partial | C5 | Tone-Bb4 | 2 |
| 6-7 * pixels/partial | Bb4 | Tone-Bb4 | 0 |
| 5-6 * pixels/partial | Ab4 | Tone-Bb4 | −2 |
| 4-5 * pixels/partial | F4 | Tone-F3 | 0 |
| 3-4 * pixels/partial | D4 | Tone-F3 | −3 |
| 2-3 * pixels/partial | Bb3 | Tone-Bb3 | 0 |
| 1-2 * pixels/partial | F3 | Tone-Bb3 | −5 |
| 0-1 * pixels/partial | Bb2 | Tone-Bb2 | 0 |

Thus, for example, with a display 320 pixels high and 8 partials assigned, a touch at Y-position of 310 pixels would fall within the $8^{th}$ partial, and correspond to a base Tone of Bb4.

A pitch adjustment of the base Tone is then determined. First, the number of semitones variation due to slide extension is calculated from the X-axis touch location according to the following equation (we assume the slide is equal to the entire display width):

Slide semitones=X position pixels*(6 semitones/Display width pixels)

This value is then added to a pre-configured number of adjustment semitones for the previously determined Tone. Sample adjustment semitone values are shown in Table 2.

Total semitones=Adjustment semitones+Slide semitones

The total semitones are then used to calculate the pitch adjustment by the following formula:

Pitch adjustment=2^(Total semitones/12)

Therefore, in this particular example, assuming display dimensions of 480 pixels wide by 320 pixels high, if the user touches location (200 pixels, 310 pixels), the touch falls within the $8^{th}$ partial which corresponds to the base Tone of Bb4 and has two Adjustment semitones. The final pitch adjustment is calculated as follows:

Slide semitones=200 pixels*(6 semitones/480 pixels)
=2.5 semitones

Total semitones=2+2.5=4.5 semitones

Pitch adjustment=2^(4.5/12)=1.3

TABLE 3

Sample activation parameters for Attack and Loop types

| Tone Bb3 | | | | |
|---|---|---|---|---|
| Attack 1 | Vol. <0.5 | Force >0.5 | Shake <0.5 | Time since last Tone <1 sec |
| Attack 2 | Vol. >=0.5 | Force >=0.5 | Shake >0.5 | Time since last Tone >1 sec |
| Loop 1 | Vol. <0.5 | Force >0.5 | Shake <0.5 | Time since last Tone <1 sec |
| Loop 2 | Vol. >=0.5 | Force >=0.5 | Shake >0.5 | Time since last Tone >1 sec |

With the Tone selected, a sound type, if available may also be selected 710. For example, if the volume, force (or touch area), and/or shake is above a certain threshold, a different attack type may be selected. Table 3 shows sample activation parameters for selecting different attack and loop types. Note that the volume may be determined from force (or area) of touch or from one of the additional sensor inputs, such as mic level, or accelerometer angle. In this case, a delay may be added to ensure that the external event is determined and flag set prior to determining the type. Attack type may also be determined from the duration between successive touches; if short, then a faster attack is used, whereas if long, a slower attack is used. In order to calculate the duration between successive touches the time of last touch must be stored and then later subtracted from the time of current touch.

With qualities of the note determined, the Tone, its type, and pitch adjustment are sent 712 to the playback processor. If 714 configured to trigger sound by touch, the playback command is sent 716 to the playback processor.

If 704 a touch is determined to have moved, a similar process is followed. The Tone and pitch adjustment are determined 718, as previously described; however, if the partial has changed from the previous partial, such as if a player was moving from a Bb up one partial to a D, a "slur" can be assumed, and the playback processor is sent 720 a slur request with the new Tone and pitch adjustment. Otherwise, if the movement has occurred within a partial, the new pitch is requested 720 of the playback processor such that it can continue to use the same base Tone but adjust the pitch.

Finally, if 706 a touch is determined to have ended, and the system is configured to trigger by touch 722, a stop is requested 724 of the playback processor. A decay phase may also be employed. In this case, the playback processor will playback a decay segment before ramping down and stopping playback. In a modified embodiment, the type of decay phase may first be determined (for example, fast vs. slow), and then sent to the playback processor along with the request for stop.

Figure 8:
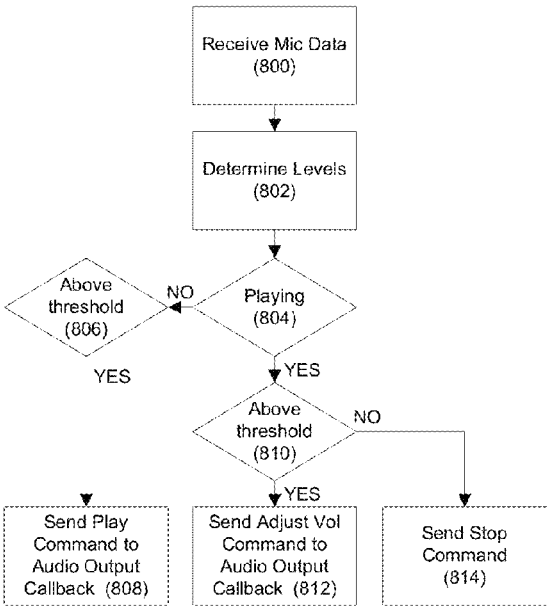
FIG. 8 is a flow diagram of the steps performed by the mic sub-processor for the embodiment of FIG. 6.

FIG. 8 shows a flow diagram of the process by which the mic sensor handles events assuming it has been selected by the user to trigger sound playback. The raw mic data is received 800 periodically and peak and average levels are determined 802 by a callback and/or timer function. If 804 the player is currently not playing and 806 the average volume level is above a particular threshold, a start request is sent 808 to the playback processor, with the Tone and pitch having separately been requested by the Touch event processor. If 804 the player is currently playing and 810 the average volume level is above the threshold, it should continue playing and a volume adjustment based on the average volume level is requested 812 of the playback processor. Finally, if 804 the player is currently playing, but 810 the average volume level is below the threshold, a stop is requested 814 of the playback processor. In another embodiment, toggling sound is controlled by touch, whereas volume can be controlled by mic.

Figure 9:
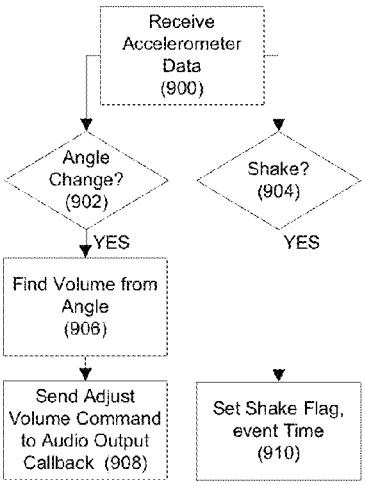
FIG. 9 is a flow diagram of the steps performed by the accelerometer sub-processor for the embodiment of FIG. 6.
Figure 10:
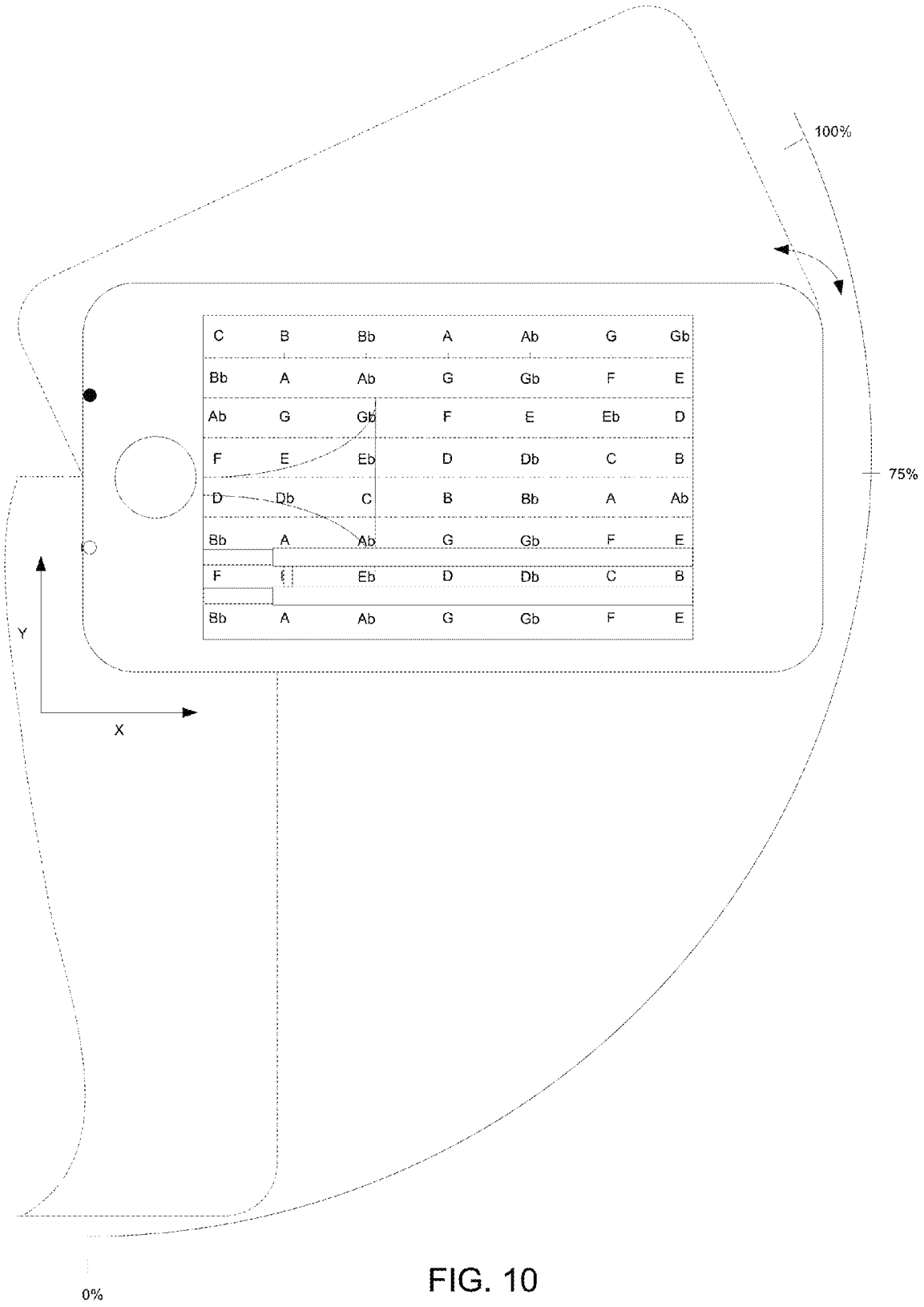
FIG. 10 is a diagram showing the embodiment of FIG. 6 configured to control volume by rotation in the XY plane.

FIG. 9 shows a flow diagram of the process by which the accelerometer sub-processor handles events. The raw data is received 900 and filtered 902, 904 to determine an actionable event. In this particular embodiment the event is either a low frequency event, such as an n angle change, or a high-frequency event, such as a shake. As shown in FIG. 10 the X-Y angle of the device is configured to correspond to a volume adjustment. At an angle of approximately 30 degrees, the invention produces maximum volume, where as, at −90 degrees it produces 0 volume. It varies linearly in this range. Referring again to FIG. 9, the X-Y angle is determined 906 and the volume adjustment is then determined. The volume adjustment is then sent 908 to the playback processor.

If 904 a shake event is detected, a flag that the event occurred and the time at which it occurred is set 910, such that any of the event processors responsible for starting playback may refer to it to determine attack type. In a modified embodiment, the shake could be configured to start and stop the sound playback, as well. In yet another embodiment, the shake could be configured to request a special playback mode of the playback processor, such as a rapid fire tonguing mode where the notes are started and stopped rapidly rather than sustained.

Trumpet

Figure 11:
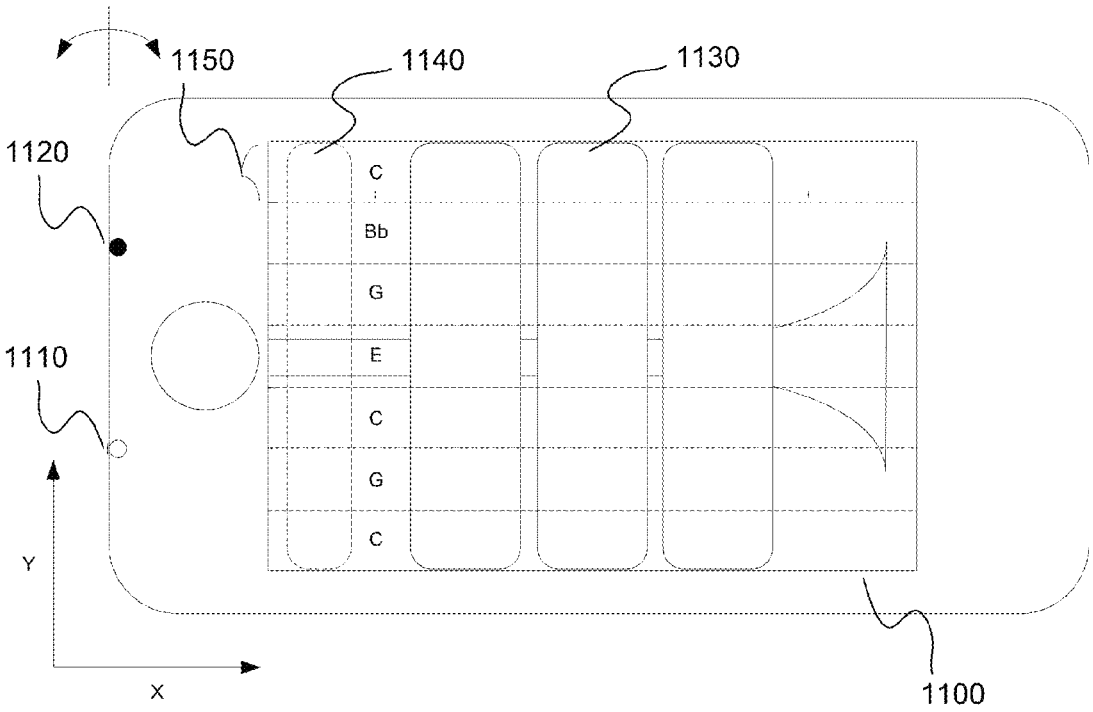

FIG. 11 shows the present invention embodied as a Trumpet. A real Trumpet consists of a length of brass tubing with a mouthpiece connected at one end, and a flared bell at the other. It has a set of three valves which when open and closed modify the effective length of the instrument and thus change pitch. As with the Trombone, sound is generated when a person "buzzes" their lips into the mouthpiece, causing the column of air inside the tubing to vibrate. Pitch is determined both by opening and closing the valves and changing the frequency of the "buzzing".

The valves are numbered 1 through 3, starting with the valve closest to the mouthpiece. The first valve decreases the pitch by 2 semitones, the second by a semitone, and the third by 3 semitones. Simultaneously, by tightening lips (embouchure) and "buzzing" at a higher frequency, users can increase the pitch to a higher partial in the overtone series. Quality, nuance and volume are determined largely by the embouchure, and air speed and direction.

As embodied by the present invention. The device has a touch display 1100, a mic 1110, and speaker 1120, with additional sensors and processor electronics contained within the case.

Various embodiments are presented. One set of embodiments determines Tone and pitch by touch exclusively, whereas another set of embodiments determines Tone and pitch by a combination of touch location and device rotation.

Figure 12:
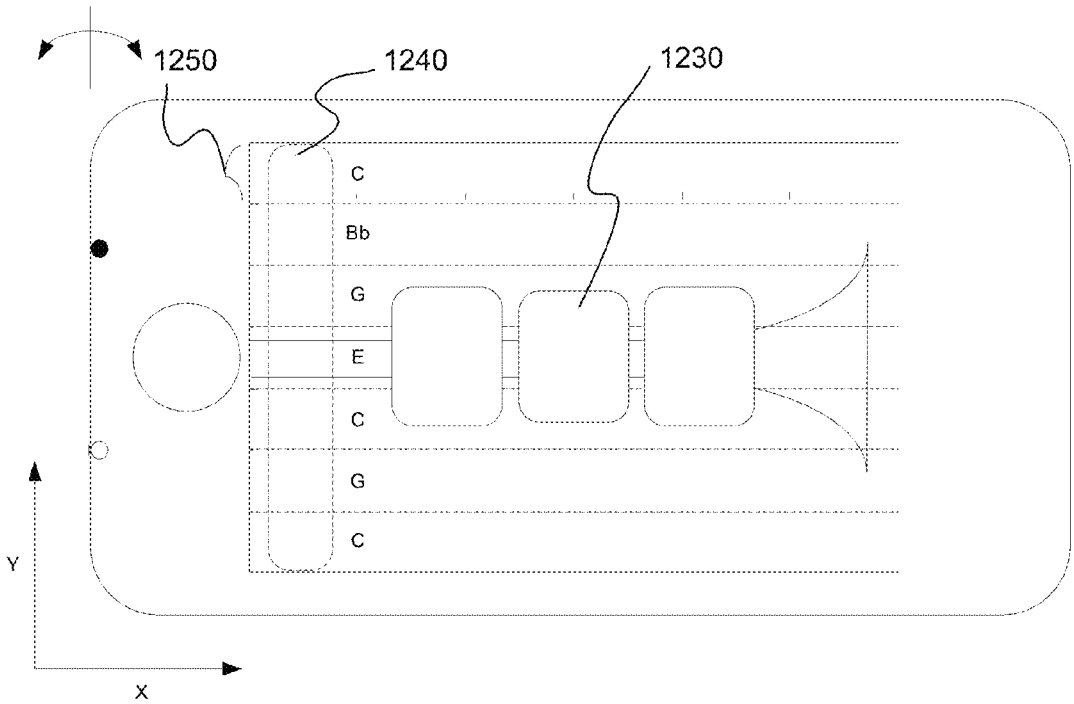

FIGS. 11 and 12 show embodiments where Tone and pitch are determined by touch exclusively. In the embodiment of FIG. 11, three areas 1130 on the display are defined, each representing a valve. An additional area 1140 is defined which represents all open valves.

In FIG. 11, the three valve areas 1130 and open valve area 1140 stretch across the height of the display, spanning 7 overtone partials 1150, such that touching a combination of keys at a particular partial level will generate a tone with that particular pitch.

In a variant of FIG. 11, there is no open valve area. The open valve state is signaled by a quick tap, rather than a sustained touch in a partial area.

In FIG. 12, the three valve areas 1230 do not correspond to a particular partial 1250. The partial is rather determined by a touch at a particular partial in the open valve area.

Figure 13A:
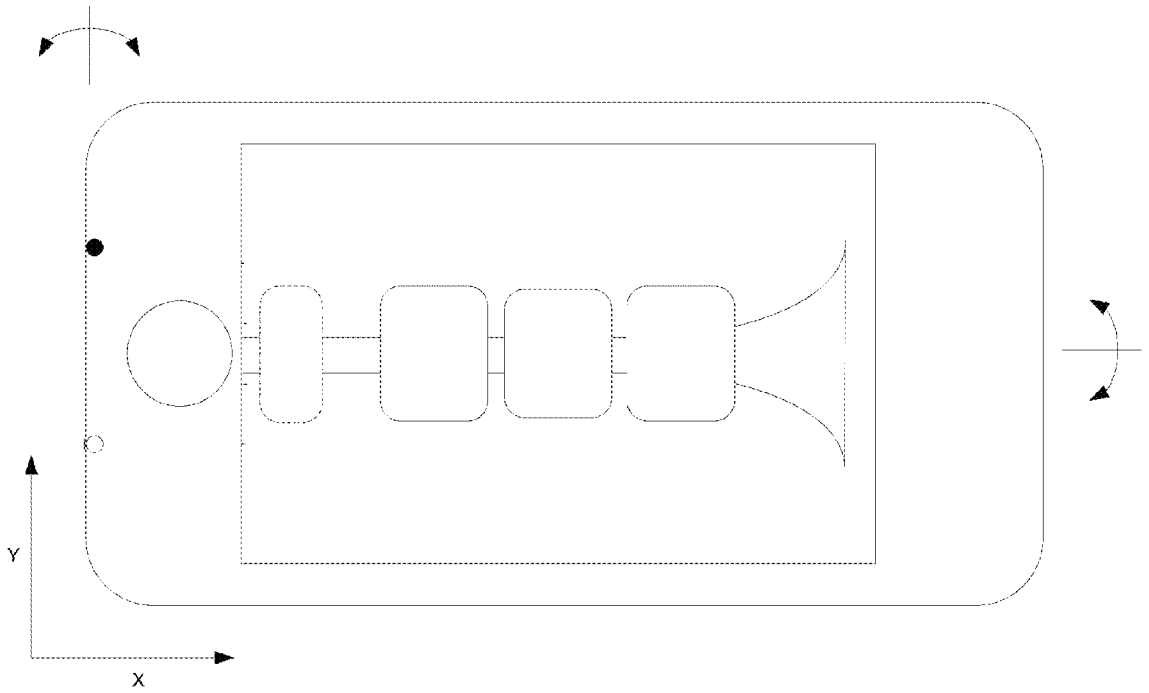
FIGS. 13A-B and 14A-B are configured to control Tone and pitch by a combination of touch and rotation.
Figure 13B:
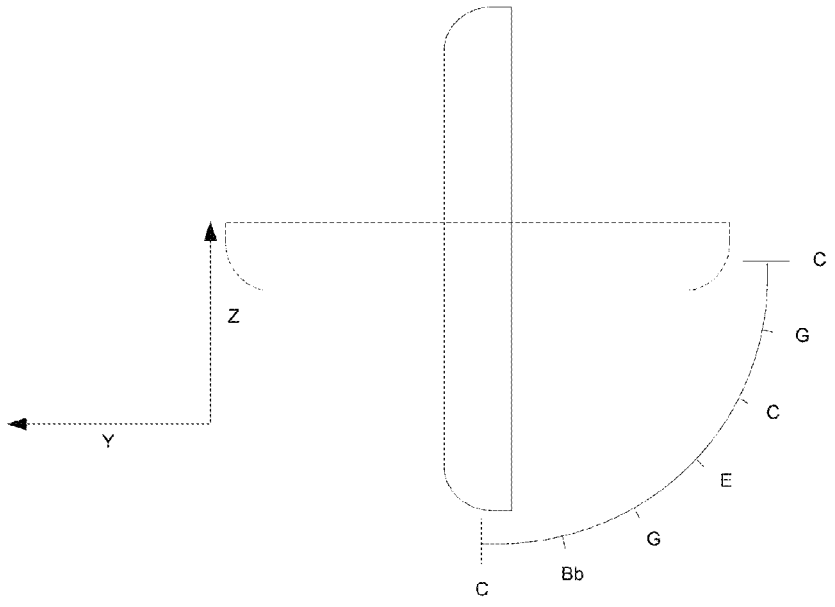
Figure 14A:
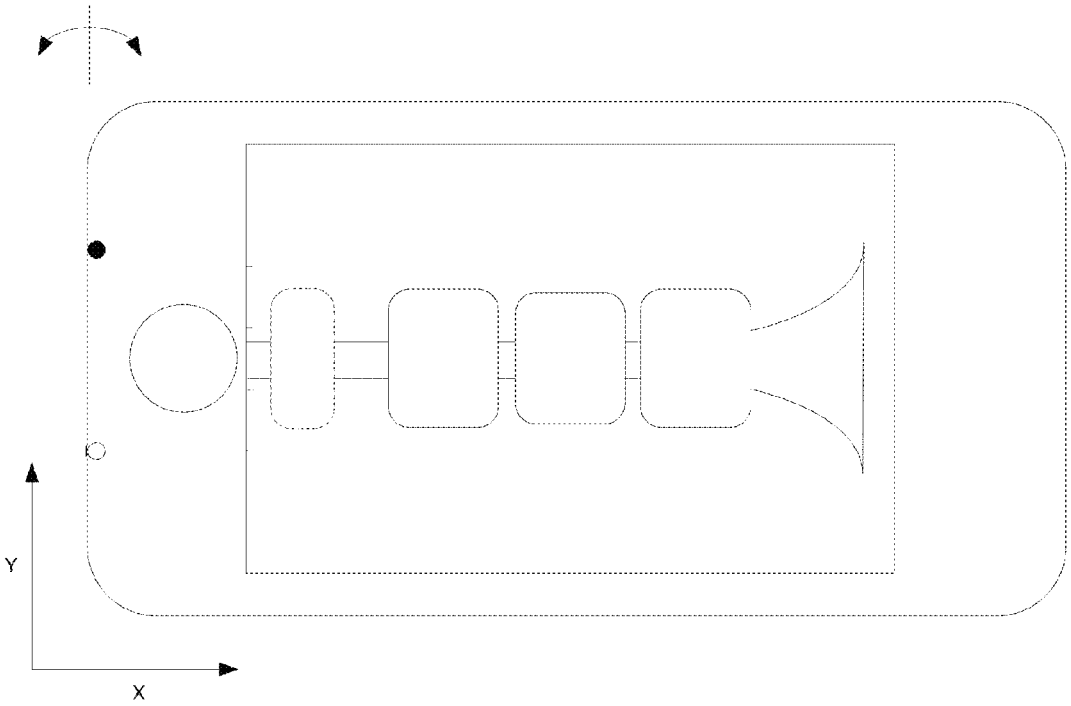
Figure 14B:
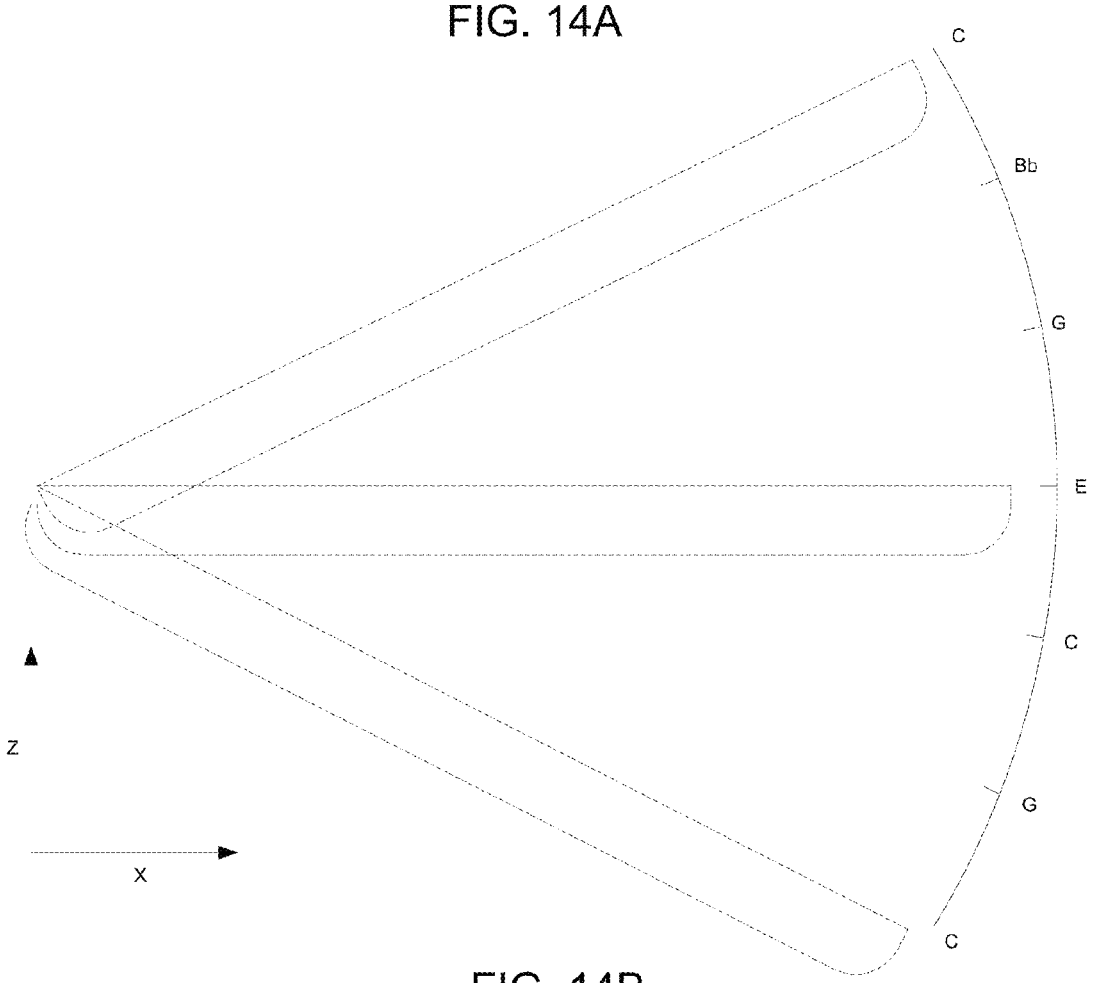

FIGS. 13A and 14A show embodiments where Tone and pitch are determined by a combination of touch location and rotation of the device. The angle of rotation is used to set the partial. In FIGS. 13A and 13B the partial is set by rotating about the X axis, whereas in FIGS. 14A and 14B, the partial is set by rotating about the Y axis.

In each of the embodiments, the sound may be triggered by various methods including, but not limited to touch, and mic levels. If mic levels are used, the open valve area is not required for embodiments of FIGS. 13 and 14 which use touch and rotation to determine pitch.

Figure 15:
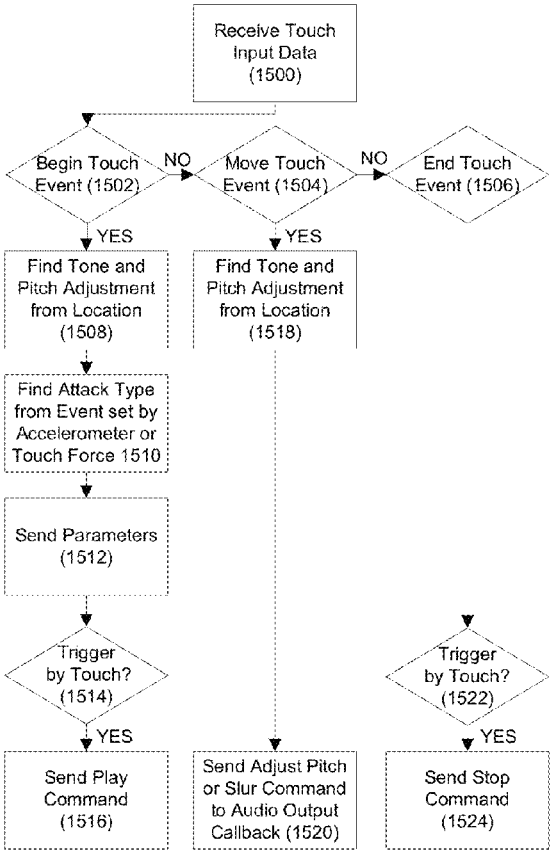
FIG. 15 is a flow diagram of the steps performed by the touch sensor sub-processor for the embodiments of FIG. 11-14.

FIG. 15 shows the flow of the process by which the Trumpet embodiments handle touch events.

Display sensor information is received 1500 periodically, and processed to determine whether a touch as begun 1502, moved 1504, or ended 1506. If a touch has begun, the Tone and pitch adjustment are determined 1508 through one of several methods depending on embodiment In embodiments of FIGS. 11 and 12, Tone and pitch are determined exclusively by touch. Areas of the display are assigned to key valves or open valves. If a touch location lies within one of these regions it is considered to be pressed. As with the previously described Trombone embodiment, the partial is first determined from the touch location along the Y-axis. A base Tone and its associated Adjustment Semitones are determined from the partial. Table 4 shows sample associations between Y-position, partial, base Tone, and adjustment semitones.

TABLE 4

Sample association between Y-position, partial, base Tone and pitch

| Y-position [pixels] | Open Valve | Assigned Tone | Adjustment Semitones |
|---|---|---|---|
| 6-7 * pixels/partial | C5 | Tone-Bb4 | 2 |
| 5-6 * pixels/partial | Bb4 | Tone-Bb4 | 0 |
| 4-5 * pixels/partial | G4 | Tone-Bb4 | −3 |

TABLE 4-continued

Sample association between Y-position, partial, base Tone and pitch

| Y-position [pixels] | Open Valve | Assigned Tone | Adjustment Semitones |
|---|---|---|---|
| 3-4 * pixels/partial | E4 | Tone-Bb4 | −6 |
| 2-3 * pixels/partial | C4 | Tone-C4 | 0 |
| 1-2 * pixels/partial | G3 | Tone-C4 | −6 |
| 0-1 * pixels/partial | C3 | Tone-C3 | 0 |

The semitone adjustment due to the valve presses is then determined. $1^{st}$ valve closed, $2^{nd}$ valve closed, and $3^{rd}$ valve closed cause 2, 1, and 3 semitone decreases, respectively. The semitone decrease is additive, such that if $1^{st}$ and $2^{nd}$ valves are closed, there is a 3 semitone decrease; likewise, if $1^{st}$ and $3^{rd}$ valves are closed, there is a 5 semitone decrease.

With the valve semitones determined, the total semitone adjustment from base Tone pitch can be determined.

Total semitones=Adjustment semitones+Valve semitones

The total semitones are then used to calculate the pitch adjustment by the following formula:

Pitch adjustment=2^(Total semitones/12)

A similar procedure is followed for the embodiments of FIGS. 13 and 14; however, the partial is determined not be touch location along the Y-axis, but by rotation. In the case of FIG. 13, rotation is within the YZ plane. And in the case of FIG. 14, rotation is within the XZ plane.

When the touch event is received, the device angle is determined from the accelerometer data, and matched to find the associated partial, base Tone, and adjustment semitones. Table 5 shows an example of the association.

TABLE 5

Sample association between YZ angle, partial, base Tone and pitch

| YZ angle [degree] | Open Valve | Assigned Tone | Adjustment Semitones |
|---|---|---|---|
| 82.5-97.5 | C5 | Tone-Bb4 | 2 |
| 67.5-82.5 | Bb4 | Tone-Bb4 | 0 |
| 52.5-67.5 | G4 | Tone-Bb4 | −3 |
| 37.5-52.5 | E4 | Tone-Bb4 | −6 |
| 22.5-37.5 | C4 | Tone-C4 | 0 |
| 7.5-22.5 | G3 | Tone-C4 | −6 |
| −7.5-7.5 | C3 | Tone-C3 | 0 |

Determination of the pitch adjustment proceeds as described for the other embodiments. In order to ensure that the angle is determined prior to partial being determined, a slight delay may be inserted.

With Tone and pitch determined, the type of attack or other quality of Tone is found 1510 as described in the Trombone embodiment. Finally, with Tone, pitch adjustment, and other Tone quality determined, the parameters are sent 1512 to the playback processor, and if 1514 set to trigger playback by touch, playback is requested 1516.

A similar process is followed if a touch moved event is received 1504. A new Tone, pitch adjustment, and note quality are determined 1518. If the Tone or partial changes a slur may be signaled 1520 to the playback processor along with the other Tone parameters.

Finally, if a touch end event is received, and 1522 the system is configured to trigger playback by touch, a playback stop is requested 1524 of the playback processor.

Figure 16:
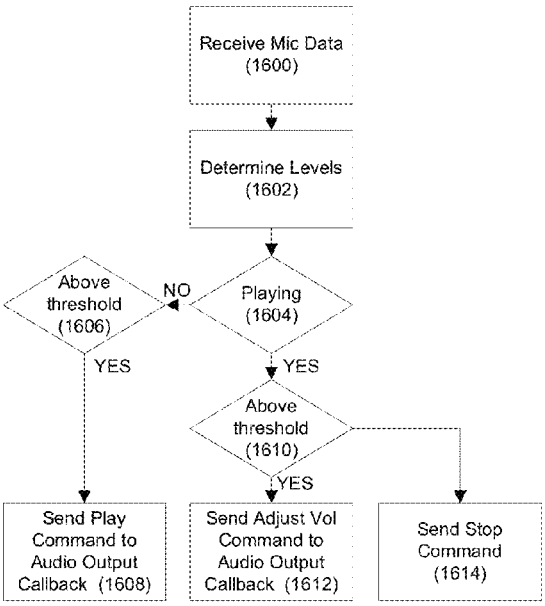
FIG. 16 is a flow diagram of the steps performed by the mic sub-processor for the embodiment of FIG. 11-14.

As in the previously described Trombone embodiment, FIG. 16 shows a flow diagram of the process by which the mic sensor handles events if it has been selected by the user to trigger sound playback. The raw mic data is received 1600 periodically and peak and average levels are determined 1602 by a callback and/or timer function. If 1604 the player is currently not playing and 1606 the average volume level is above a particular threshold, a start request is sent 1608 to the playback processor, with the Tone and pitch having separately been requested by the Touch event processor. If 1604 the player is currently playing and 1610 the average volume level is above the threshold, it should continue playing and a volume adjustment based on the average volume level is requested 1612 of the playback processor. Finally, if 1604 the player is currently playing, but 1610 the average volume level is below the threshold, a stop is requested 1614 of the playback processor. In another embodiment, toggling sound is controlled by touch, whereas volume can be controlled by mic. In yet another embodiment, mic input can be used to determine partial. A Fourier transform is done on the mic input to determine its pitch. It is then matched to the set of partial pitches to select the closest partial.

Figure 17:
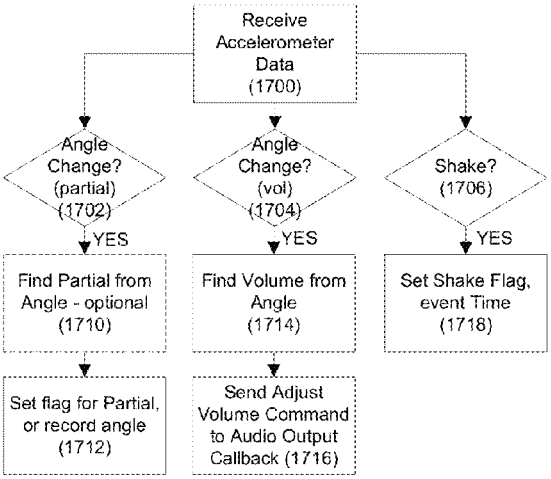
FIG. 17 is a flow diagram of the steps performed by the accelerometer sub-processor for the embodiment of FIG. 11-14.

FIG. 17 shows a flow diagram of the process by which the accelerometer handles events. The raw data is received 1700 and filtered 1702-1706 to determine an actionable event. In this particular embodiment the event is either an angle change, or a shake. The angle change may correspond either to a change in volume, or a change in partial, as would be the case with the embodiments of FIGS. 13 and 14. If 1702 the angle change occurs about an axis configured to correspond to a partial, the angle itself is stored 1712 for later query by the touch event processor, or the partial is determined 1710 as described previously and in accordance with FIGS. 13 and 14, and stored 1712 for later reference by the touch event processor.

If 1704 the angle change occurs about an axis configured to correspond to volume, the volume can be determined 1714 as previously described in accordance with FIG for the Trombone embodiment. With volume determined, it is sent 1716 to the playback processor.

If 1706 a shake event is detected, a flag that the event occurred and the time at which it occurred is set 1718, such that any of the event processors responsible for starting playback may refer to it to determine attack type. In a modified embodiment, the shake could be configured to start and stop the sound playback, as well.

Saxophone

Figure 18A:
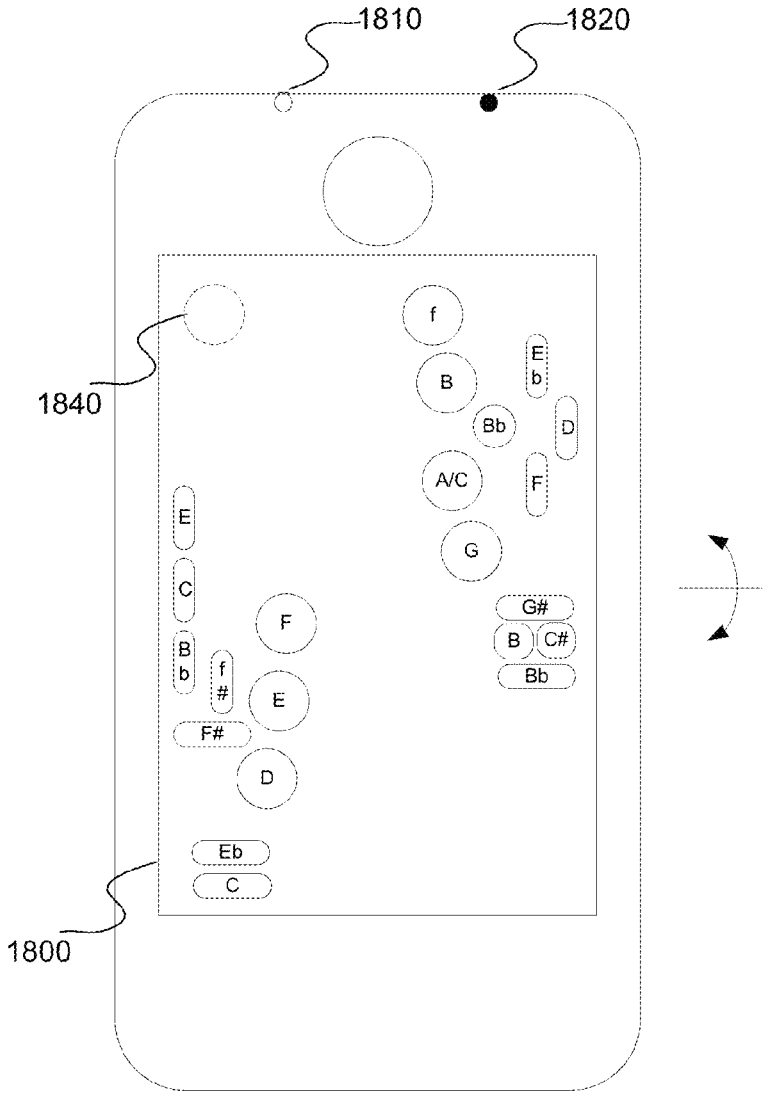
FIG. 18A is the front of the device.
Figure 18B:
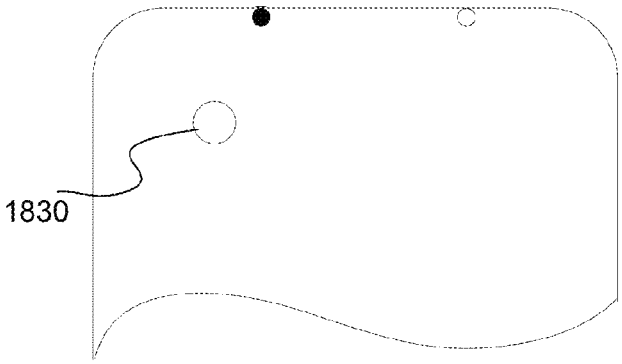
FIG. 18B is the back of the device.

FIG. 18 shows the present invention embodied as a Saxophone. A real Saxophone consists of a length of brass tubing with a mouthpiece connected at one end, and a flared bell at the other. It has a series of holes which are covered and uncovered by pads which are controlled by pressing a series of keys. Keys are pressed by both left and right hands, including the left and, sometimes, right thumbs. Sound is generated when a person blows into the mouthpiece and vibrates the reed. Pitch is determined by wind and reed vibration and the combination of keys pressed.

By changing the oral cavity users can "lip up" to higher partials to play altissimo notes. However, they can reach many notes by the standard keys, which include the octave key. Quality, nuance and volume are determined largely by the shape of the oral cavity, lip position, wind speed and direction.

As embodied by the present invention. The device has a touch display 1800, a mic 1810, and speaker 1820, with additional sensors and processor electronics contained within the case.

Areas for each key are defined on the display. There are the left hand main keys (B, A/C, G, front F, and Bb), palm keys (D, Eb, F), and little finger keys (G#, Low C#, Low B, Low Bb). There are also right hand main keys (F, E, D, F#), side keys (E, C, Bb, High F#), and little finger keys (Low Eb, Low C). A thumb key for changing octave may also be located on the display, or an alternate input may be used, such as the camera 1840 located on the back of the device. If sound is to be triggered by touch, an open key area is also defined to indicate that no keys are pressed, but sound is to be played. Base Tone and pitch are determined by location of touches in these regions. As with other embodiments, volume is determined by mic level, force (or area) of touch on the display, or angle of the device as determined by an accelerometer. Attack type, note quality and other nuance are determined by shaking the device, or may be linked directly to volume, or duration of notes.

Figure 20:
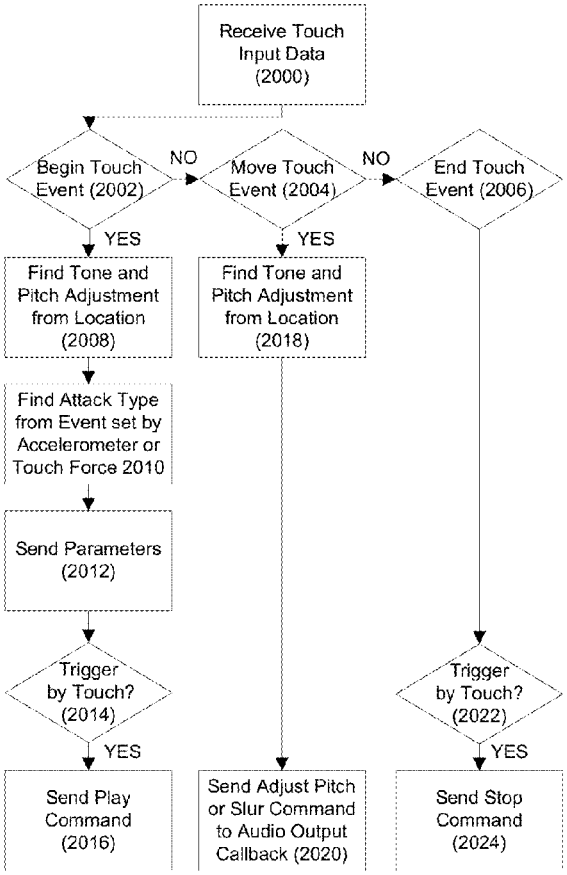
FIG. 20 is a flow diagram of the steps performed by the touch sensor sub-processor for the embodiments of FIGS. 18 and 19.

FIG. 20 shows a flow diagram of the process by which the processor handles touch events. Display sensor information is received 2000 periodically, and processed to determine whether a touch has begun 2002, moved 2004, or ended 2006. If 2000 a touch has begun, the Tone and pitch adjustment are determined 2008 based on location of the touch.

Similarly to the other previously described embodiments, partial or level is first determined, followed by adjustment due to key presses. The Saxophone differs from the Trumpet embodiments in that there is less reliance on partial shift, and more on key press shift. With the standard key arrangement (including thumb octave key) the instrument is capable of two and a half octaves. Altissimo registers can also be reached extending the range to 3 or even 4 octaves.

Figure 19:
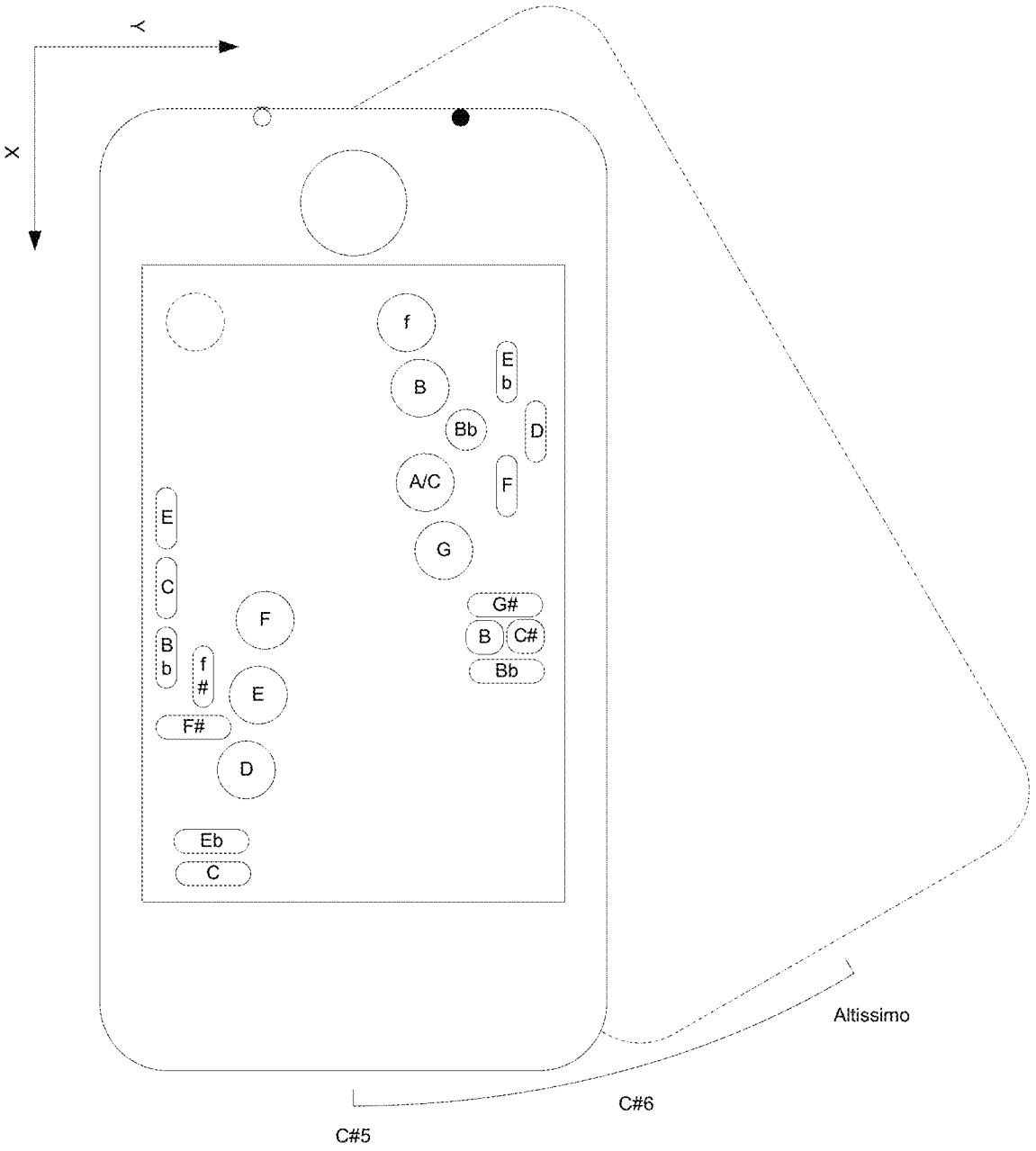
FIG. 19 is a diagram of the embodiment of FIG. 18 configured to set octave and/or partial by rotation in the XY plane.

Partial, or octave shift, can be set through various methods. In one embodiment (FIG. 18B) the camera 1830 is used as a thumb octave key. In another embodiment, the device can be rotated in the XY plane, as shown in FIG. 19 to raise the octave and enter altissimo registers. To each partial, octave or level, a base Tone with corresponding adjustment semitones is assigned.

Locations of the touches are then used to determine key presses. As with the other embodiments, the semitone shift due to key presses is then added to the base Tone adjustment semitones to determine the final pitch shift of the base Tone.

Attack type and other qualities of the note is then determined 2010. With Tone, pitch adjustment, note quality and any other parameters determined, they are sent 1512 to the playback processor. If 2014 configured to trigger playback by touch, playback is also requested 2016.

A similar process is followed if 2004 a touch moved event is received. A new Tone, pitch adjustment, and note quality are determined 2018. If the note changes a slur may be signaled 2020 to the playback processor along with the other Tone parameters.

Finally, if 2006 a touch end event is received and 2022 playback is configured to be triggered by touch, a playback stop is requested 2024 of the playback processor.

Figure 21:
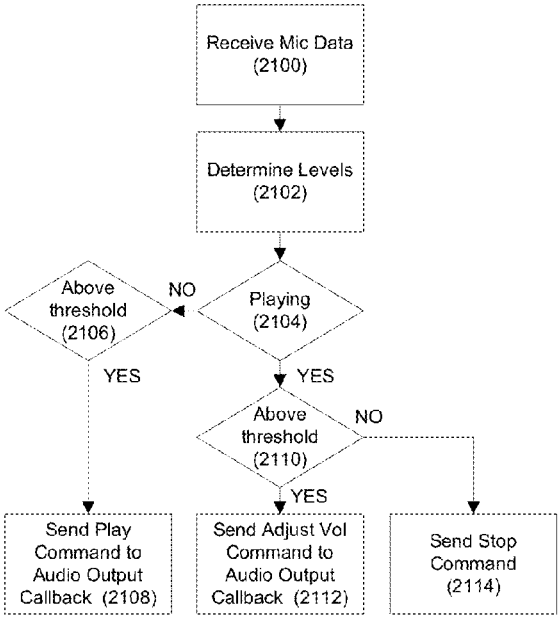
FIG. 21 is a flow diagram of the steps performed by the mic sub-processor for the embodiments of FIGS. 18 and 19.
Figure 22:
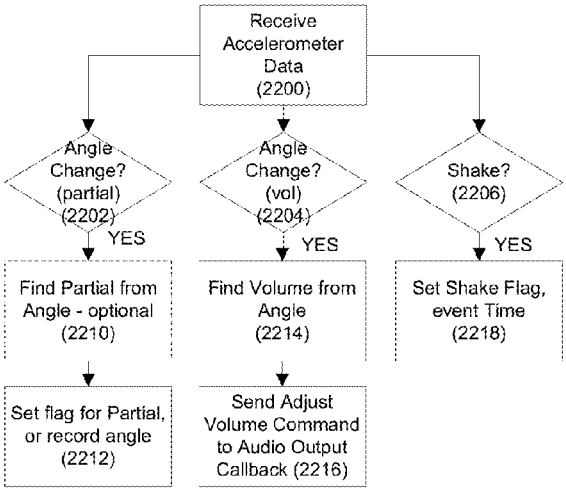
FIG. 22 is a flow diagram of the steps performed by the accelerometer sub-processor for the embodiments of FIGS. 18 and 19.

FIGS. 21 and 22 show the process by which mic events and accelerometer events are handled, respectively. These processes proceed similarly to those of the previously described Trumpet embodiments.

Figure 23:
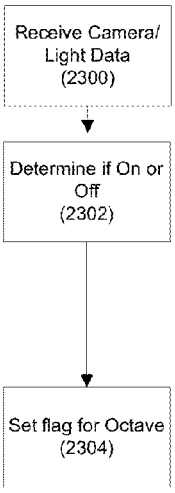
FIG. 23 is a flow diagram of the steps performed by the camera sub-processor for the embodiments of FIGS. 18 and 19.

FIG. 23 shows the process by which camera input is handled to set the octave shift. The data is received 2300 periodically, processed 2302 to determine whether light is on or off, and the octave shift flag is set 2304 accordingly.

The invention has now been described with reference to the preferred embodiments. Alternatives and substitutions will now be apparent to persons of skill in the art.

What is claimed is:

1. A method for controlling sound using an electronic device capable of detecting a user input gesture in a two dimensional plane, the method modeled after the method for controlling sound using a wind musical instrument wherein pitch of sound produced by said wind musical instrument is determined by a combination of a first user input and a second user input, said first user input related to controlling the frequency of vibration of the column of air inside said wind musical instrument, and second user input related to controlling the length or effective length of said wind musical instrument containing the column of air, said method comprising:

a. detecting one or more user inputs gestures in said two dimensional plane;

b. determining a first pitch factor in accordance with the location of at least one of said detected user input gestures along a first axis of said two dimensional plane, said first factor corresponding to said first user input of said wind musical instrument;

c. determining a second pitch factor in accordance with the location of at least one of said detected user input gestures along a second axis of said two dimensional plane, said second factor corresponding to said second user input of said wind musical instrument; and, d. determining a parameter for controlling pitch of said sound in accordance with said first pitch factor and said second pitch factor.

2. The method of claim 1 wherein said user input gestures are touch inputs.

3. The method of claim 1 wherein said first pitch factor comprises a pitch.

4. The method of claim 1 wherein said first pitch factor comprises a stored digitized waveform and a pitch shift from the inherent pitch of said stored digitized waveform to the pitch at an origin point.

5. The method of claim 1 wherein determining a first pitch factor comprises selecting from a set of two or more pitch factors, each pitch factor of said set corresponding to a different region along said first axis.

6. The method of claim 1 wherein determining a second pitch factor comprises associating a pitch shift with distance along said second axis from an origin point.

7. The method of claim 1 wherein said parameter for controlling pitch is a pitch adjustment relative to the inherent pitch of a stored digitized waveform.

8. The method of claim 1 wherein said parameter for controlling pitch is the pitch relative to a pre-determined reference pitch.

9. The method of claim 1 wherein said one or more user input gestures are two or more user input gestures.

10. The method of claim 1 wherein determining a second pitch factor comprises:

a. associating a pitch shift with a set of areas along said second axis;

b. determining which of said areas are occupied by said one or more gestures; and, c. determining the total of said pitch shifts for said occupied areas.

11. The method of claim 1 further comprising determining the angle of rotation of said device, and determining the volume in accordance with said angle of rotation.

12. The method of claim 1 further comprising detecting acceleration associated with said user input gesture, and determining a parameter for controlling amplitude or an amplitude-related spectral characteristic of sound in accordance with said acceleration.

13. The method of claim 1 further comprising detecting a continuous movement of said one or more user input gestures from a first area associated with a first pitch factor to a second area adjacent to said first area and associated with a second pitch factor, said second pitch factor different from said first pitch factor by more than one semitone, and said method further comprises generating an instruction to transition from a first pitch to a second pitch, said instruction responsive to said movement.

14. A computer readable memory comprising computer code for implementing a method for controlling sound using an electronic device capable of detecting a user input gesture in a two dimensional plane, the method for controlling sound modeled after the method for controlling sound using a wind musical instrument wherein pitch of sound produced by said wind musical instrument is determined by a combination of a first user input and a second user input, said first user input related to controlling the frequency of vibration of the column of air inside said wind musical instrument, and second user input related to controlling the length or effective length of said wind musical instrument containing the column of air, said method comprising:

e. detecting one or more user inputs gestures in said two dimensional plane;

f. determining a first pitch factor in accordance with the location of at least one of said detected user input gestures along a first axis of said two dimensional plane, said first factor corresponding to said first user input of said wind musical instrument;

g. determining a second pitch factor in accordance with the location of at least one of said detected user input gestures along a second axis of said two dimensional plane, said second factor corresponding to said second user input of said wind musical instrument; and, h. determining a parameter for controlling pitch of said sound in accordance with said first pitch factor and said second pitch factor.

15. The method of claim 14 further comprising determining the angle of rotation of said device, and determining the volume in accordance with said angle of rotation.

16. The method of claim 14 further comprising detecting acceleration associated with said user input gesture, and determining a parameter for controlling amplitude or an amplitude-related spectral characteristic of sound in accordance with said acceleration.

17. The method of claim 14 further comprising detecting a continuous movement of said one or more user input gestures from a first area associated with a first pitch factor to a second area adjacent to said first area and associated with a second pitch factor, said second pitch factor different from said first pitch factor by more than one semitone, and said method further comprises generating an instruction to transition from a first pitch to a second pitch, said instruction responsive to said movement.

18. The method of claim 9 wherein said at least one of said detected user input gestures in accordance with which said first pitch factor is determined is different in location from said at least one of said detected user input gestures in accordance with which said second pitch factor is determined.

19. The method of claim 1 wherein said at least one of said detected user input gestures in accordance with which said first pitch factor is determined is the same as said at least one of said detected user input gestures in accordance with which said second pitch factor is determined.

20. The method of claim 14 wherein determining a second pitch factor comprises:

d. associating a pitch shift with a set of areas along said second axis;

e. determining which of said areas are occupied by said one or more gestures; and, f. determining the total of said pitch shifts for said occupied areas.

* * * * *